United States Patent [19]

Ross

[11] 4,408,680

[45] Oct. 11, 1983

[54] LADDER SUPPORT ASSEMBLY

[76] Inventor: Don O. Ross, Rte. 1, Box 458, Gulfport, Miss. 39503

[21] Appl. No.: 241,250

[22] Filed: Mar. 6, 1981

[51] Int. Cl.[3] ..... E06C 5/04; E06C 7/46

[52] U.S. Cl. ..... 182/68; 182/108; 182/127

[58] Field of Search ..... 182/127, 63–68, 182/97, 95, 107, 108, 109

[56] References Cited

U.S. PATENT DOCUMENTS 209,250 10/1878 Gilchriest ..... 182/64

279,545 6/1883 Dempster et al. ..... 182/66

461,521 10/1891 Lovejoy ..... 182/108

2,611,466 9/1952 Biggert ..... 182/97

*Primary Examiner*—Reinaldo P. Machado

*Attorney, Agent, or Firm*—Charles C. Garvey, Jr.

[57] ABSTRACT

A ladder support for use with a vehicle wherein the lowermost portion of a ladder could be pivotally and detachably connected to the vehicle bumper, and cables attached between the upper portion of the ladder and the vehicle to hold the ladder in a position leaning away from the vehicle.

4 Claims, 10 Drawing Figures

LADDER SUPPORT ASSEMBLY

DESCRIPTION

Background of the Invention

1. Technical Field

The present invention relates to ladder supports. More particularly, the present invention provides a ladder support for use with vehicles wherein the lowermost portion of the ladder affixes pivotally to a vehicle which will support at least in part the ladder with the uppermost portion of the ladder being supported by tensile cables with the ladder normally leaning away from the vehicle and the tensile cables providing tensile support to prevent movement of the ladder away from the vehicle with which it is used.

2. General Background

In any number of light industries, small businesses, medium industries, and the like, there is a need for an inexpensive way to place a human worker a distance above the ground. Many devices are known which are usually complex in nature that place a worker a distance above the ground so that he might change lightbulbs in street signs, change bulbs in stop lights, perform other tasks on elevated signs, electrical and the like, or do other required manual or related repair operations. Many devices have been patented which provide elevation in the form of a ladder support. Sometimes the ladder support provides a ladder assembly which can be supported off a wheeled vehicle with the ladder collapsing in some fashion to facilitate transportation after a particular job is completed.

In that regard, U.S. Pat. No. 2,164,327 issued to P. E. Hawkins and entitled "Utility Truck" shows a July 4, 1939 patent having a vehicle supporting a ladder arrangement on its top in a very permanent type support apparatus.

U.S. Pat. No. 2,245,481 issued June 10, 1941, to A. J. Kiley, et al provides a "Portable Aerial Ladder." In that patent, again there is seen a fairly complex permanent type installation involving a vehicle and a ladder which could be moved to an operative position allowing a worker to ascend a distance above the ladder and the vehicle.

U.S. Pat. No. 2,586,531 provides a "Wheeled Support having Ladder Assembly," wherein the lowermost portion of the ladder was attached to the bumper area of a vehicle with support beams attaching at one end portion to the vehicle and at the other end portion to the uppermost area of the ladder in a rigid fashion.

U.S. Pat. No. 3,043,398 issued July 10 , 1962 to R. G. Bakula provides a "Wheeled Vehicle having a Ladder Assembly." That patent likewise shows a complex permanent type installation of a ladder assembly upon a wheeled vehicle.

The devices illustrated in these patents are generally complex and form a permanent portion of the vehicle with which they are used. Problems with this type of installation relate to the expense the complexity, the maintenance, the permanence and related problems. The devices shown in the above patents would in many cases be too expensive for a small businessman or small entrepreneur to utilize. Further, many small businesses, small contractors, individuals, and the like are not in a position to commit an expensive vehicle to the sole purpose of its use as a ladder support assembly as is the case with the above-discussed patents.

Further, many small businesses, small contractors, individuals, and the like require an apparatus which can be easily used and operated by a single individual, often the sole proprietor of a small business or a repairman or a contractor working alone.

3. General Discussion of the Present Invention

The present invention solves these problems and shortcomings by providing a ladder assembly which is relatively inexpensive, easily disassembled, easily assembled and erected, and removable from the vehicle with which it is associated during periods of nonuse.

The present invention provides a ladder having a pair of spaced apart parallel rails with a plurality of rungs connecting the rails. A pair of support brackets attached to the bumper of the vehicle with which the support ladder is used are provided with a pair of feet mounted on the ladder at the lower end portion thereof being removably attached during operation to the pair of brackets respectively. The feet are nonetheless usable in a conventional fashion as feet on the ladder if the ladder were used in a normal fashion supported by the ground, for example, as used by a painter, construction worker, or the like and leaned against a building or other structure.

At least one flexible tensile cable is attached during operation at one end portion to the ladder and at the other end portion thereof having means for removably affixing the cable to the vehicle body with which the apparatus is used and which vehicle body will support the cable at that end portion.

In the preferred embodiment, a pair of spaced apart cables are provided which attach respectively at opposite sides of the ladder to a provided bar. At the opposite end portion, each cable attaches to a provided anchor which is easily mountable to a vehicle body.

the feet are preferably removably attached during operation to a pair of provided brackets, each bracket having an outwardly projecting cantilevered section supporting a transverse pin which interlocks with a recess formed on the lowermost portion of each foot.

The brackets having the cantilevered sections are attached by bolting, welding, or the like to the bumper of a vehicle to be supported with the cantilevered section of each bracket depending outwardly from the bumper and with each cantilevered section being parallel to the other. Rubber pads can be provided on the bottom of each of the ladder feet to allow their use in a conventional fashion, and the bottom of each foot does provide an opening for pinned attachment, for example, of a conventional ladder foot thereto.

Thus, it is an object of the present invention to provide a fully collapsible, fully removable ladder support apparatus for use with vehicles.

Another object of the present invention is to provide a ladder support apparatus using flexible cables to secure the uppermost portion of the ladder.

It is another object of the present invention to provide a ladder support apparatus which assembles and disassembles in a matter of minutes.

It is another object of the present invention to provide a ladder support apparatus for use with vehicles using low cost, easy-to-obtain components which operate in a maintenance-free fashion.

It is another object of the present invention to provide a ladder support apparatus which is of utility to vehicle owners unable to utilize their vehicle as a ladder support apparatus at all times.

It is another object of the present invention to provide a ladder support apparatus for use with vehicles which can be manufactured in kit form, easily usable with conventional ladders presently being manufactured and sold.

It is another object of the present invention to provide a ladder support assembly for vehicles which allows use of the ladder portion thereof both in combination with the vehicle and apart from the vehicle as a conventional ladder without great modification to the ladder itself.

It is another object of the present invention to provide a ladder support apparatus for use with vehicles which allows the ladder to be supported on the vehicle at a variety of angles and at a variety of heights with minimum modification.

BRIEF DESCRIPTION OF THE DRAWINGS

For a further understanding of the nature and objects of the present invention, reference should be had to the following detailed description, taken in conjunction with the accompanying drawings,in which like parts are given like reference numerals and wherein.

BEST MODE FOR CARRYING OUT THE INVENTION

Figure 10:
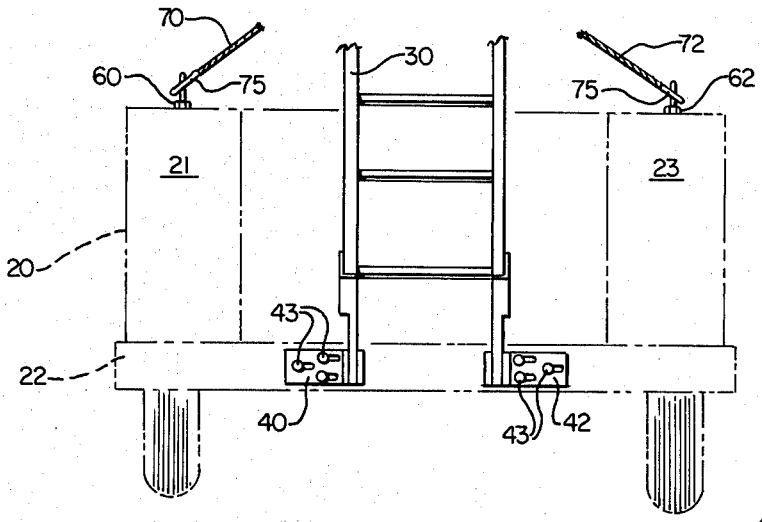
FIG. 10 is a partial rear view of the preferred embodiment of the apparatus of the present invention with the vehicle supporting the apparatus shown in phantom lines.
Figure 1:
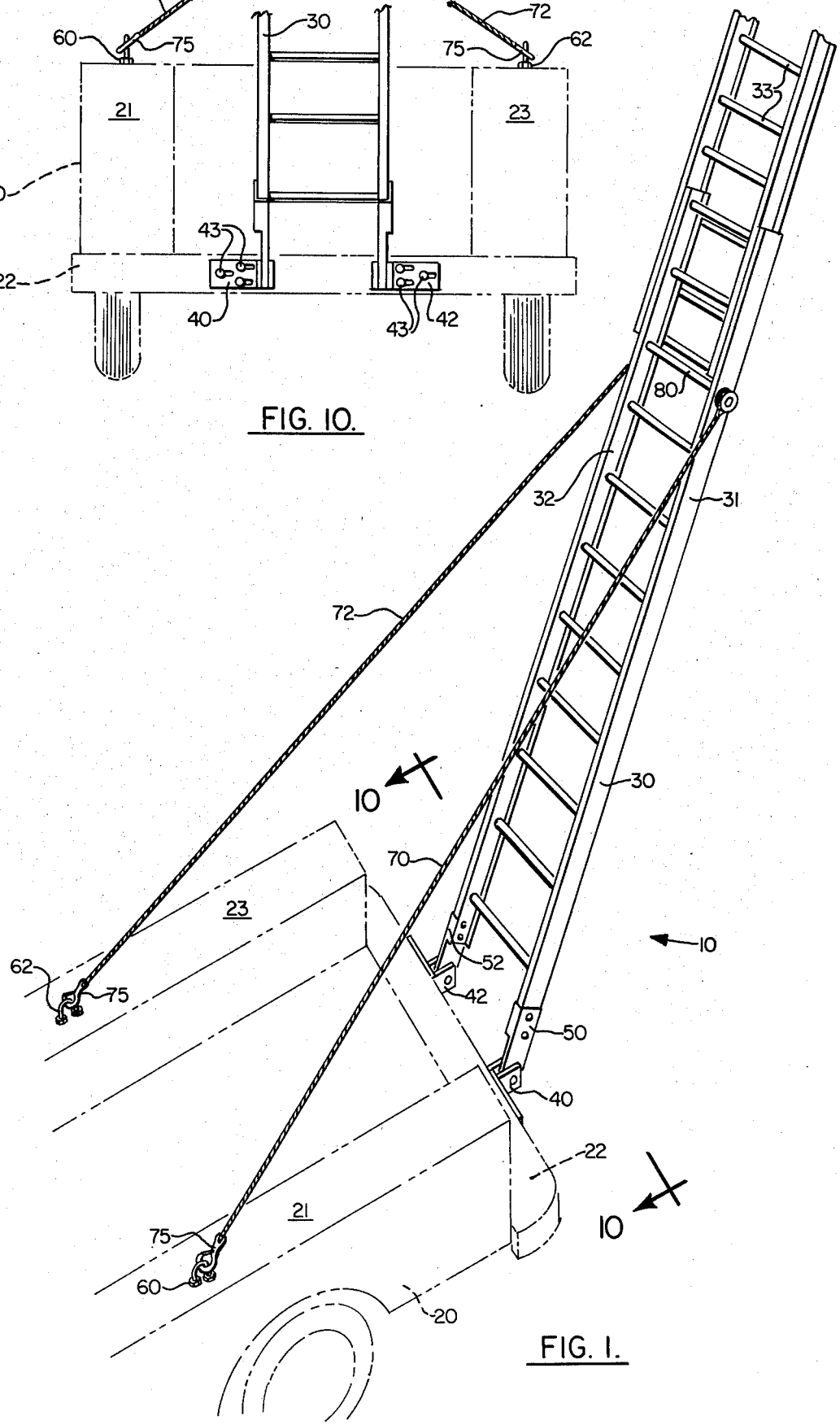
FIG. 1 is a perspective view of the preferred embodiment of the apparatus of the present invention.

FIGS. 1 and 10 best show the preferred embodiment of the apparatus of the present invention designated generally by the numeral 10.

As shown in phantom lines in FIGS. 1 and 10 is a vehicle 20 which could be, for example, a truck having a bumper 22 portion which during operation will support at least in part ladder 30 as will be described more fully hereinafter.

A pair of spaced apart rails 31, 32 are provided which comprises ladder 30 in combination with rungs 33 as is the case with conventional ladders such as extension ladders and the like.

A pair of bumper brackets 40, 42 attach by bolting using bolts 43, for example, to bumper 22 or other such means. Each bumper bracket 40, 42 during operation interlocks with a lowermost pair of feet 50, 52 which are shown more particularly in FIGS. 6–8. The construction of brackets 40, 42 can be seen best in FIGS. 2–4.

A pair of anchors 60, 62 which could be, for example, U-bolts, padeyes, or the like could be attached by bolting, welding, or the like to the sides 21, 23 of vehicle 20.

Figure 5:
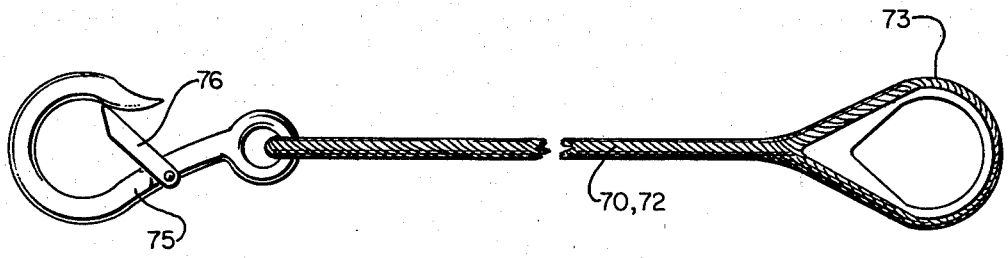
FIG. 5 is a partial side view of the cable portion of the preferred embodiment of the apparatus of the present invention.

Attached at one end portion to anchor 60, 62, are cables 70, 72 as best seen in FIGS. 1 and 10. The opposite end portion of each cable 70, 72 affixes to a provided elongated bar 80 best seen in FIG. 9. Support bar 80 provides at one end portion a pair of annular collars 81, 82 defining therebetween a recess 83 which normally would be occupied during operation and as seen in FIG. 1 by eyelet 73 of cables 70, 72, with each cable 70, 72 providing an eyelet 73 as shown in FIG. 5.

The opposite end portion of each cable 70, 72 provides, for example, a hook 75 having a spring loaded latch 76 as is known. Such a hook is commercially available and would be attached by conventional means to one end portion of its respective cable 70, 72. Hooks 75 are seen also in FIGS. 1 and 10.

Figure 9:
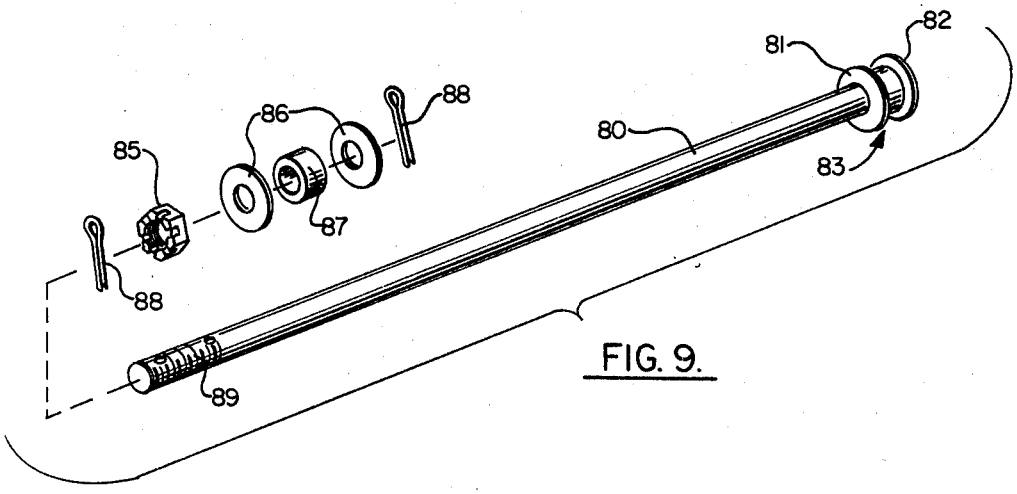
FIG. 9 is a perspective exploded view of the support bar portion of the preferred embodiment of the apparatus of the present invention.

During operation bar 80 would be affixed to ladder 30 by bolting, for example, with the bolt and washer connection being illustrated in FIG. 9 as bolt 85, washers 86, and bushing 87. Codder pins are needed and as illustrated in FIG. 9 could be also utilized with the codder pins being designated by the numeral 88.

One end portion 89 of bar 80 would be threaded to receive the bolted connection. A pair of holes equal to or slightly greater than the diameter of bar 80 need to be bored through ladder 30 as shown in FIG. 1. Alternatively, bar 80 could affix through the center of a rung 33 if such a rung were hollow. Such openings through rung 80 are seen in some conventional aluminum ladders.

Bushing 87 provides a recess between washers 86 similar to the recess 83 between collars 81, 82. However, the bushing 87 would provide an attachment for eyelet 73 of one cable 70 or 72 at the bolted connection side thereof.

Figure 2:
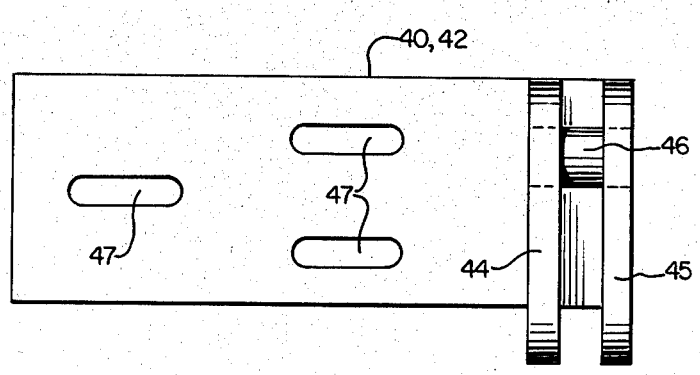
FIG. 2 is a front view of the bracket portion of the preferred embodiment of the apparatus of the present invention.
Figure 3:
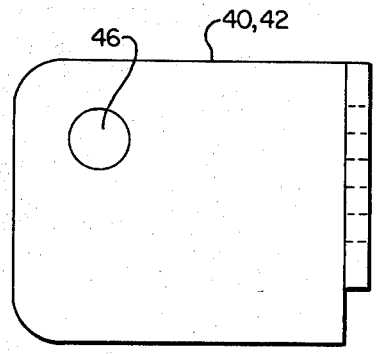
FIG. 3 is a side view of the bracket of FIG. 2.
Figure 4:
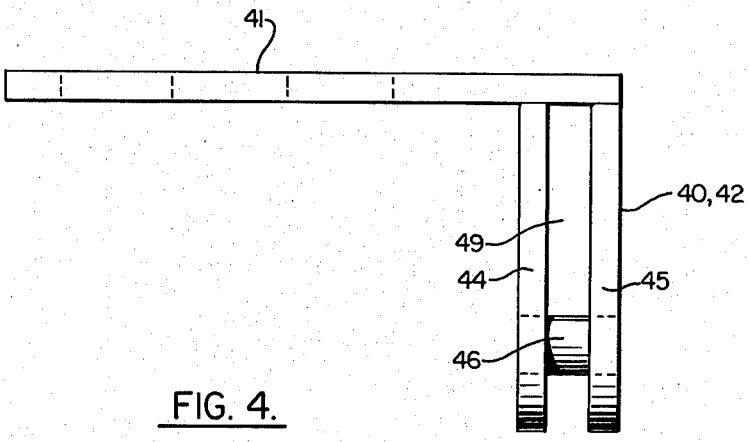
FIG. 4 is a top view of the bracket of FIGS. 2 and 3.
Figure 6:
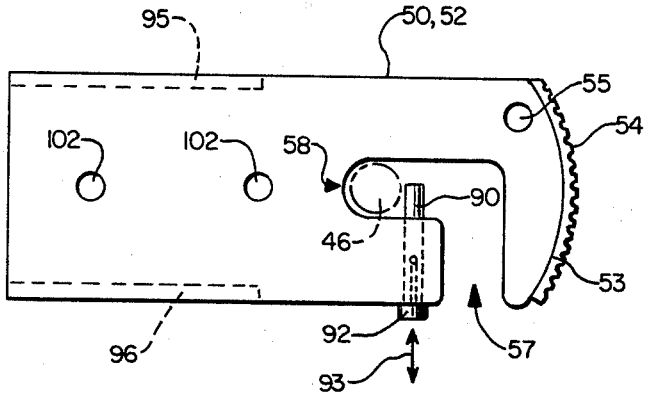
FIG. 6 is a front view of the foot portion of the preferred embodiment of the apparatus of the present invention.
Figure 7:
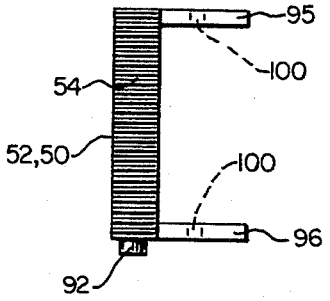
FIG. 7 is a bottom view of the foot shown in FIG. 6.
Figure 8:
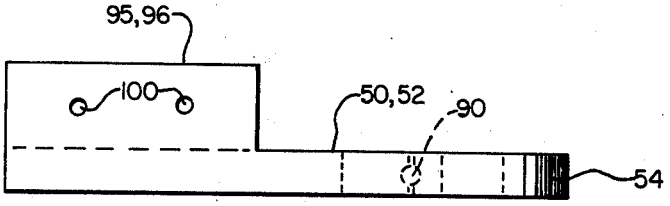
FIG. 8 is a side view of the foot shown in FIGS. 6 and 7.

FIGS. 2–4 show more particularly the construction of bumper brackets 40, 42. Each bracket 40, 42 provides a base plate 41 which would preferably be flat of, flat bar or the like and be provided with any desired number of slots or openings 47 through which bolts 43 could be attached. Alternatively, plate 41 could be welded or attached by like means to the bumper of a vehicle with which each bracket will be used. A pair of cantilevered sections 44, 45 depend outwardly from plate 41 and are attached thereto at roughly right angles by welding, for example. In the preferred embodiment, cantilevered sections 44, 45 would be spaced apart providing a gap 49 therebetween which would be occupied in part by a support pin 46. Gap 49 would also be occupied in a removable fashion by either of feet 50, 52 as is shown in FIG. 1. The construction of feet 50, 52 is seen in FIGS. 6–8. Each foot provides preferably a curved bottom 53 to which is attached, for example, a serrated rubber pad 54 as best seen in FIGS. 6 and 7. Also shown at the bottommost portion of foot 50, 52 is an opening 55 which could be, for example, utilized for pinning a conventional ladder foot to foot 50 or 52 at opening 55. Any suitable round metallic pin or bolt could be used, such items being readily available at hardware stores and the like.

An L-shaped recess 57 is seen in FIG. 6. This would allow an interlocking arrangement of foot 50, 52 with bracket 40, 42 with pin 46 occupying the position shown in phantom lines in FIG. 6 during operation.

A spring loaded pin 90 would provide a head 92 portion which could be grasped and pulled outwardly (see arrow, 93 of FIG. 6) so as to allow pin 46 to register inwardly fully into recess 57 and occupy the position adjacent the upper most portion of recess 57 which is designated by the numeral 58 in FIG. 6.

In FIG. 8, a sideview of foot 50 or 52 shows it to be of a thickness T which would be substantially equal to or less than the thickness of gap 49 of each bracket 40, 42. A pair of flanges 95, 96 are provided on each foot which would allow a bolted, riveted or like attachment of each foot 50, 52 to its respective rail 31, 32 of ladder 30. Openings could be provided, for example, in each flange 95, 96 which openings are designated by the numeral 100 in FIG. 8.

Openings 102 are also seen in FIG. 6 as provided in foot 50 or foot 52. These openings would allow a bolted or riveted connection of foot 50, 52 itself to ladder 30 at rails 31, 32. Shims or shim plates (not shown) could be placed between flanges 95, 96 and the ladder rails 31, 32 to allow for dimensional differences and fit because of different manufacture. In that regard, the present invention could be sold in kit form, easily adapting existing truck, vehicle the like.

Brackets 40, 42 as well as feet 50, 52 could be manufactured of any suitable structural material such as steel or like metallic substances, or any structurally superior plastic material or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A ladder support assembly for use with vehicles comprising:

a ladder having a pair of spaced apart generally parallel rails, a plurality of rungs connecting said rails, and a rearwardly facing L-shaped slot in the bottom portion of each of said rails;

a bottom part on said rails substantially the width of said rails for gripping the ground whereby said ladder may be supported on the ground in a conventional manner when not supported by said vehicle;

a pair of support brackets, each comprising a pair of spaced apart cantilevered sections forming a channel with a support pin across the channel adapted to engage said slots; and at least two flexible tensile support cables, each attached during operation at one end portion to said ladder between the end portions thereof and at the other end portion having means for removably affixing each of said cables to said vehicle body to thereby determine the angle formed by the ladder and the vehicle chassis.

2. The apparatus of claim 1 wherein there is further provided an elongated pin placed laterally through said ladder at the upper portion of said ladder and outcropping on each side portion thereof, and adapted to removably engage said end portions of said cables on the outcropping portions of said pin.

3. A ladder support assembly kit capable of being used to adapt a conventional vehicle having a bumper and a conventional ladder having a pair of spaced apart generally parallel rails and a plurality of rungs connecting said rails so that said ladder so adapted will be removably supported upwardly by said vehicle so adapted, said kit comprising the combination of:

a pair of feet each having a rearwardly facing L-shaped slot in the bottom portion and each adapted to be mounted at the bottom of one of said rails with a plurality of fasteners;

each of said pair of feet having a bottom part for gripping the ground substantially the width of said foot whereby the ladder may be supported on the ground in a conventional manner when not supported by said vehicle;

a pair of support brackets each comprising a pair of spaced apart cantilevered sections forming a channel with a support pin across said channel adapted to engage said slots in said feet;

a plurality of fasteners adapted to attach said brackets to said bumper;

a pair of tensile support cables;

a plurality of fasteners adapted to removably attach said cables to said vehicle body; and a plurality of fasteners adapted to removably attach said cables to the upper portion of said ladder.

4. The ladder support assembly kit of claim 3 wherein the plurality of fasteners adapted to removably attach said cables to the upper portion of said ladder comprises an elongated pin adapted to be placed laterally through said ladder at the upper portion of said ladder and outcropping on each side portion thereof, and adapted to removably engage said end portions of said cables on the outcropping portions of said pin.

* * * * *